US006237587B1

(12) United States Patent
Sparling et al.

(10) Patent No.: US 6,237,587 B1
(45) Date of Patent: May 29, 2001

(54) WOODBURNING FIREPLACE EXHAUST CATALYTIC CLEANER

(75) Inventors: Ralph C. Sparling, Cloudcroft; Lance C. Grace, Alamogordo; Lincoln D. Busselle, Albuquerque, all of MN (US)

(73) Assignee: Temeku Technologies Inc., Albuquerque, NM (US)

( * ) Notice: Subject to any disclaimer, the term of this patent is extended or adjusted under 35 U.S.C. 154(b) by 0 days.

(21) Appl. No.: 09/368,837

(22) Filed: Aug. 5, 1999

(51) Int. Cl.[7] ..... F24B 1/18

(52) U.S. Cl. ..... 126/500; 126/307 R; 126/312; 110/203; 110/210; 422/177

(58) Field of Search ..... 126/289, 312, 126/77, 307 R, 67, 80, 58, 512, 83, 500; 110/203, 210–213, 214; 422/177, 180; 502/307

(56) References Cited

U.S. PATENT DOCUMENTS

| | | | | |
|---|---|---|---|---|
| 2,658,742 | * | 11/1953 | Suter et al. | 110/210 |
| 3,691,346 | | 9/1972 | Dyre et al. . | |
| 3,998,758 | * | 12/1976 | Clyde | 252/307 |
| 4,054,418 | | 10/1977 | Miller et al. . | |
| 4,225,561 | | 9/1980 | Torres . | |
| 4,373,452 | * | 2/1983 | Van Dewoestine | 110/210 |
| 4,422,437 | * | 12/1983 | Hirschey | 110/210 |
| 4,494,525 | * | 1/1985 | Albertsen | 126/289 |
| 4,557,250 | * | 12/1985 | Kramert | 110/210 |
| 4,844,051 | * | 7/1989 | Horkey | 110/211 |
| 5,599,456 | | 2/1997 | Fanning . | |
| 5,701,882 | | 12/1997 | Champion . | |
| 5,759,400 | | 6/1998 | Fanning . | |
| 5,934,268 | | 8/1999 | Onocki . | |

* cited by examiner

*Primary Examiner*—James C. Yeung
(74) *Attorney, Agent, or Firm*—Seymour Levine

(57) ABSTRACT

Pollutants in the exhaust from wood burning in a fireplace are removed by positioning reticulated foam between the smoke chamber and the flue. The reticulated foam is a three dimensional latticework of interconnected ligaments forming a porous, open-celled structure with a large internal surface area. The internal surfaces are coated with a catalytic material which converts pollutants in the exhaust to harmless compounds. Heat from the exhaust, when the fire is burning, maintains the catalyst at a temperature for efficient conversion operation. Thermostatically controlled heaters are embedded in the foam, or thermostatically controlled electrical current is applied directly to the catalyst, to raise the catalyst temperature when the fire is growing or smoldering, periods during which the exhaust temperature is insufficient for good conversion operation.

36 Claims, 7 Drawing Sheets

WOODBURNING FIREPLACE EXHAUST CATALYTIC CLEANER

BACKGROUND OF THE INVENTION

1. Field of the Invention

The invention pertains to the maintenance of air quality, and more particularly to the reduction of air pollutants from woodburning fireplace emissions.

2. Description of the Prior Art

In recent years the quality of the air has received major consideration. Clean air has become more than a phrase. Significant efforts have been expended to minimize pollutants in the air we breath. Some examples of these efforts are: emission standards have been imposed on automobile exhausts, incinerators in apartment houses have been shut down, and large garbage burning incinerators must meet established standards or be shut down.

Several of the compounds produced during the combustion of wood are of great concern to environmentalists and to environmental organizations, such as the Federal Government's Environmental Protection Agency (EPA), interested in maintaining, or in some cases establishing, clean air. The problem of air pollution caused by the compounds produced when wood burns has been recognized by many, and a growing number of state and local environmental agencies are considering the regulation of wood burning devices.

Emission standards for a majority of combustion processes have been established by the EPA. Though acceptable emission levels for wood burning stoves have been set, there are, however, no federal emission standards for wood burning fireplaces. The lack of standards for a wood burning fireplace is attributable to the fact that, presently, no device exists which can significantly reduce the pollutants emitted from a fireplace when wood burns. These pollutants are varied and many. The primary pollutants being; particles of organic compounds, carbon monoxide, volatile organic compounds, and nitrous oxides.

This lack of emission reduction devices for fireplaces has prompted regulatory agencies, in areas of the country where emissions from wood burning fireplaces are restricted, to ban their use in times of air pollution alerts. Overall, the number of days during which the operation of wood burning fire places are banned is increasing, as are the number of communities that ban their use.

One fireplace pollutant removal device of the prior art utilizes a filter, a fan, and a smoke detector. In operation, the filter is placed in the flue, the fan is positioned above the filter to draw the exhaust gases up through the filter, and the smoke detector is mounted in front of the fireplace. The smoke detector acts as a monitor of gases reflected from a clogged filter and provides an alarm when the filter needs cleaning. A method of removing the clogged filter provides a roll of thin filter-paper which is scrolled through the flue as segments of the filter-paper saturate with pollutants. Since the filter paper may be combustible, this pollutant removal device is a fire hazard and therefore, unacceptable. Assuming that a fire is not caused by over heating the filter paper, when the paper clogs smoke will be emitted from the fireplace into the area adjacent to the wood burning chamber, creating a smoke hazard.

Another fireplace pollutant filter of the prior art utilizes a ceramic fiber duct positioned, along the flow path of the combustion products, between the combustion chamber and the flue. A first duct portion promotes secondary combustion of unburned products of combustion and a second duct portion directs products of combustion from the front of the combustion chamber to the flue. Though some pollutants may be removed by this device by the secondary combustion, many may enter the atmosphere due to an incomplete removal by the secondary combustion and the lax of pollutant removal from the combustion products flowing through the second duct.

Although there are many catalytic devices designed to reduce pollutants in fluid streams, the backpressures created by these devices are too high to allow proper fireplace operation. The increased backpressure hinders the fireplace's draw, causing a variety of unacceptable consequences, including smoke escaping into the house instead of up the chimney.

SUMMARY OF THE INVENTION

The deficiencies of the prior art are overcome in the present invention by properly positioning a reticulated foam, having a ceramic substrate coated with catalytic material, in the fluid flow path of the exhaust from the burning wood. Reticulated foam is a three dimensional latticework of interconnected ligaments forming a porous, open-celled structure. Matter forming the structure covers only 5 to 10 percent of the overall volume. Thus, reticulated foam has an extremely large surface area per volume. Coating the surface area with catalytic material causes fluids flowing therethrough to be exposed to large surface areas of pollutant conversion material. In accordance with the invention, reticulated foam is configured for the location in the fluid flow path at which it is positioned. Heat from the exhaust of the burning wood maintain the catalyst at an efficient conversion temperature. Conversion of pollutants to harmless compounds while a fire is growing or smoldering, periods when the catalyst may not be operating efficiently due to the relatively low temperatures of the exhaust, is accomplished by embedding thermostatically controlled heaters in the reticulated foam. These heaters are activated when the temperature of the exhaust is below a predetermined temperature and are deactivated when the temperature is above the predetermined temperature. The temperature of the catalyst may also be maintained by coupling a thermostatically controlled electrical source directly to the catalyst. Current from the electrical source flowing through the catalyst, which is a poor conductor of electricity, creates heat, causing the temperature of the catalyst to rise.

DESCRIPTION OF THE PREFERRED EMBODIMENTS

Figure 1:
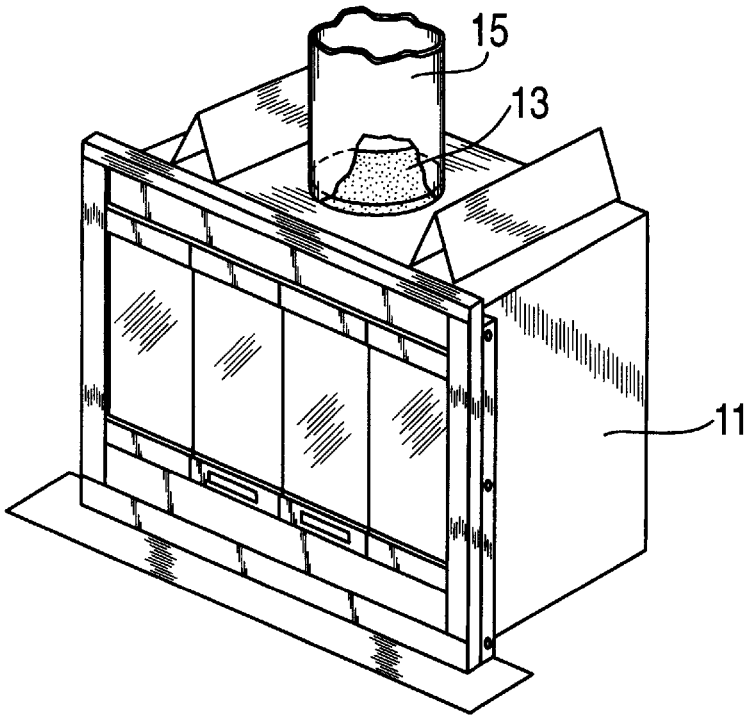
FIG. 1 is a drawing of a woodburning fireplace with an exhaust catalytic cleaner positioned at the base of the flue.

Refer now to FIG. 1, wherein a fireplace 11 with an exhaust catalytic cleaner 13, positioned at the base of the flue 15 is shown. When a fire is burning in the fireplace 11, exhaust gases from the woodburning process pass through the exhaust catalytic cleaner 13 wherein air pollutants present in the smoke emitted from the fire are converted into harmless compounds. After passing through the exhaust catalytic cleaner 13 a non-polluting exhaust enters the flue 15 from which a clean exhaust is emitted to the surrounding air.

Figure 2:
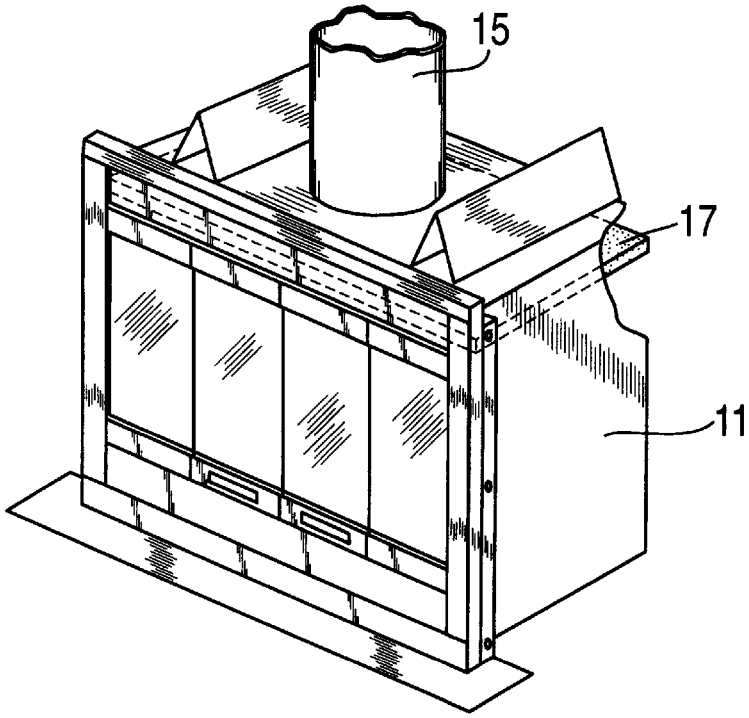
FIG. 2 is a drawing of a woodburning fireplace with an exhaust catalytic cleaner positioned at the top of the smoke chamber.

Though the exhaust catalytic cleaner is shown as a circular disk positioned at the base of the flue in FIG. 1, it should be recognized that the cleaner can be configured in many ways and positioned anywhere between the woodburning fire and the flue. Another exhaust catalytic cleaner form is shown in FIG. 2. As shown in the figure, the exhaust catalytic cleaner 17 is rectangular and positioned at the top of the smoke chamber between the fire and the flue. Depending upon the size of the fireplace 11, the rectangular exhaust catalytic cleaner 17 may comprise one or more sections to completely cover the smoke chamber.

Figure 3:
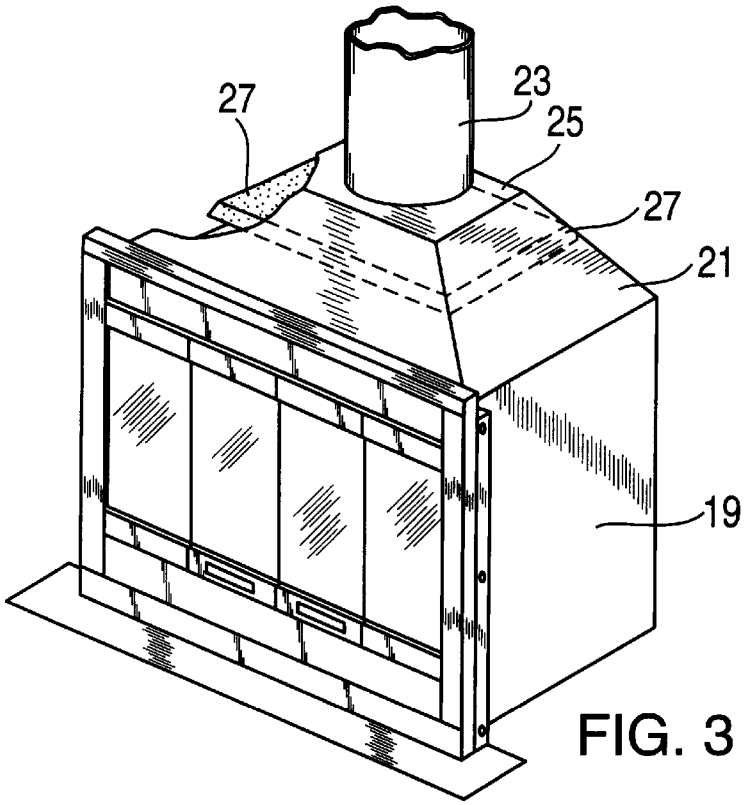
FIG. 3 is a drawing of a second woodburning fireplace with an exhaust catalytic cleaner positioned at the base of the flue with clearance for the damper.

Another type of woodburning fireplace 19 is shown in FIG. 3. This fireplace is constructed with a truncated pyramidal structure 21 capping the firebox. A flue 23 extends from the truncation 25. An exhaust catalytic cleaner 27 may be configured for positioning in the truncation 25, as shown in the FIG. 3. The exhaust catalytic cleaner 27 may be configured to provide clearance for a damper, not shown, which, in the open position, may extend into the truncated pyramid.

Figure 4:
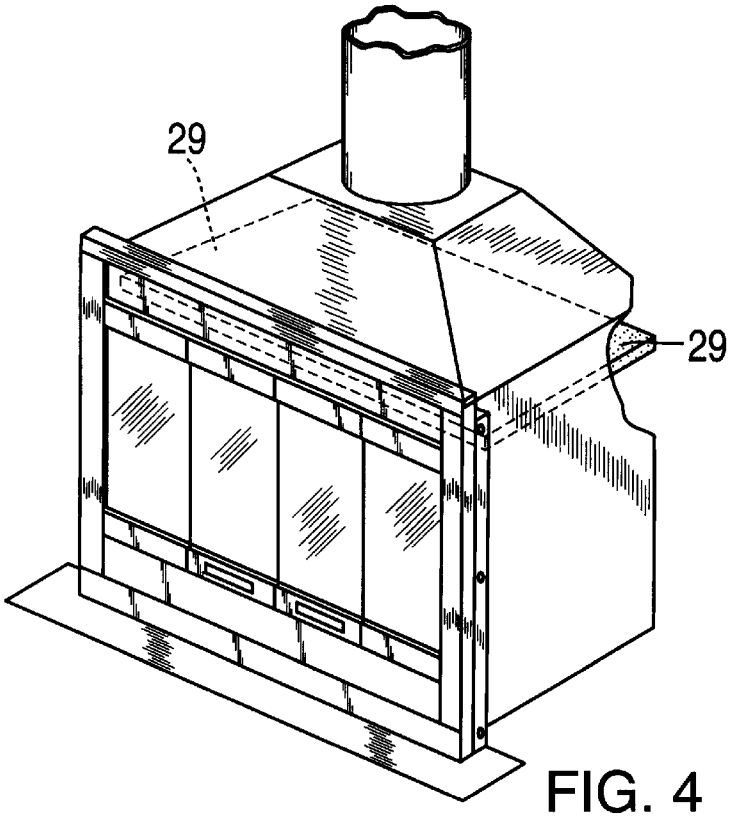
FIG. 4 is a drawing of a second woodburning fireplace with an exhaust catalytic cleaner at the top of the smoke chamber.

Instead of positioning the catalytic cleaner in the flue, an exhaust catalytic cleaner comprising one or more rectangular sheets 29 may be positioned at the top of the smoke chamber beneath the truncated pyramid, as shown in FIG. 4. Positioning the cleaner at this location allows for a more simple overall configuration, albeit that more reticulated foam may be required.

Figure 5:
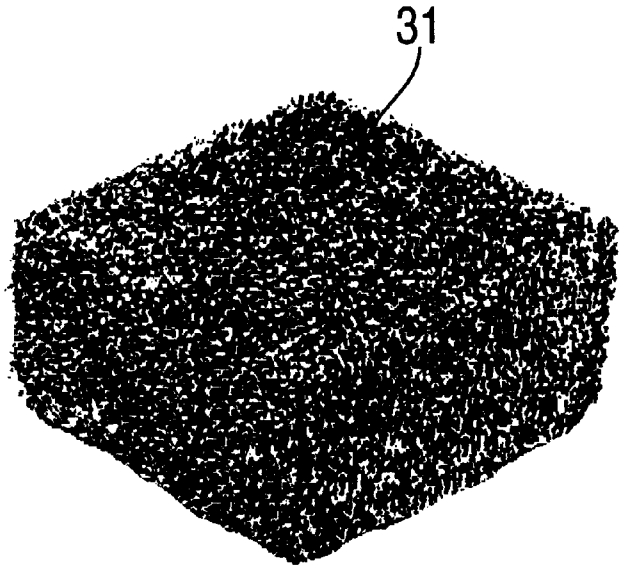
FIG. 5 is a representation of a woodburning fireplace catalytic cleaner comprising one or more sheets of reticulated foam.
Figure 6:
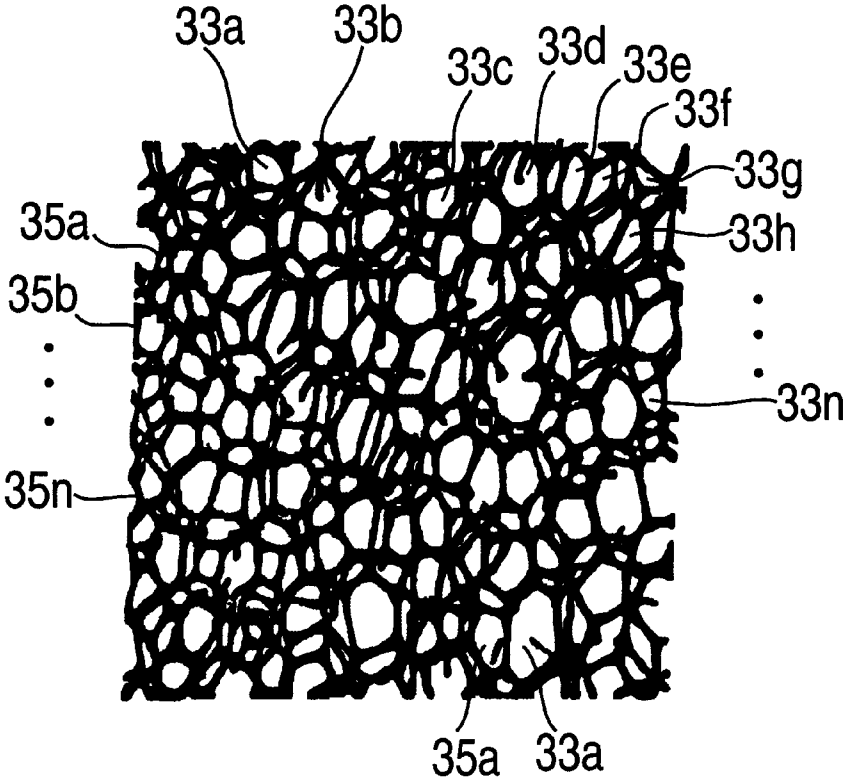
FIG. 6 is a magnified representation of a group of cells in the reticulated foam of FIG. 1.

Reticulated foam is a porous, three dimensional lattice structure of interconnected ligaments arranged to form an open-celled structure which has a very high internal surface area per foam volume. Reticulated foam, a block of which is shown in FIG. 5, appears somewhat like a sponge. Since the majority of the block comprises space between interconnected ligaments, reticulated foam has a very low material density. This low material density is illustrated in FIG. 6, which is a blown up slice of the block of FIG. 5. As shown in FIG. 6, the foam includes a series of interconnected cells (pores) 33*a* through 33*n* formed by ligaments 35*a* through 35*n* surrounding the cells. As may be inferred from FIG. 6, each pore is connected to a large number of adjacent pores, normally 12 or more.

Figure 7:
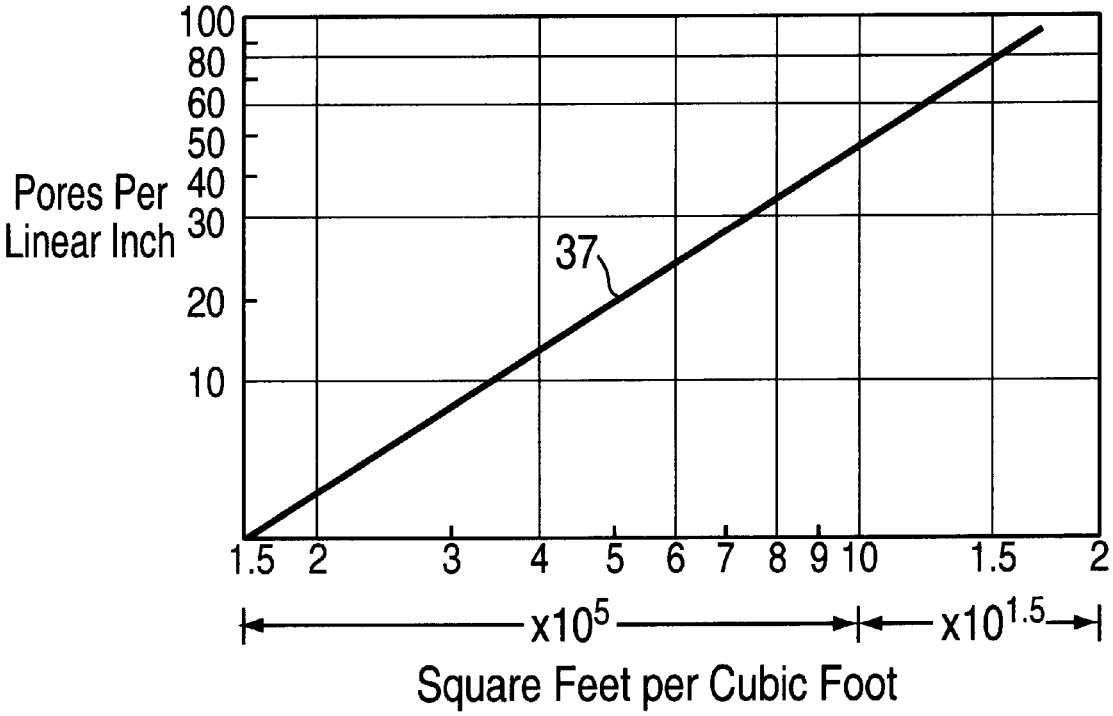
FIG. 7 is a graph showing the number of cells per linear inch in a reticulated foam as a function of the reticulated foam volume.

Pore dimensions are kept relatively constant throughout a block of reticulated foam. Thus the internal surface area per volume of a block of reticulated foam is determined by the number of cells per linear inch within the block. FIG. 7 is a graph relating the number of pores per linear inch to the internal surface area per cubic foot of a typical reticulated foam. The relationship is logarithmic, thus, when plotted on a log-log grid the relationship is shown as a straight line 37. As an example of the use of the graph, if one desires a foam having 320 square feet of internal surface area per cubic foot, one should provide 10 pores per linear inch of foam.

Figure 8:
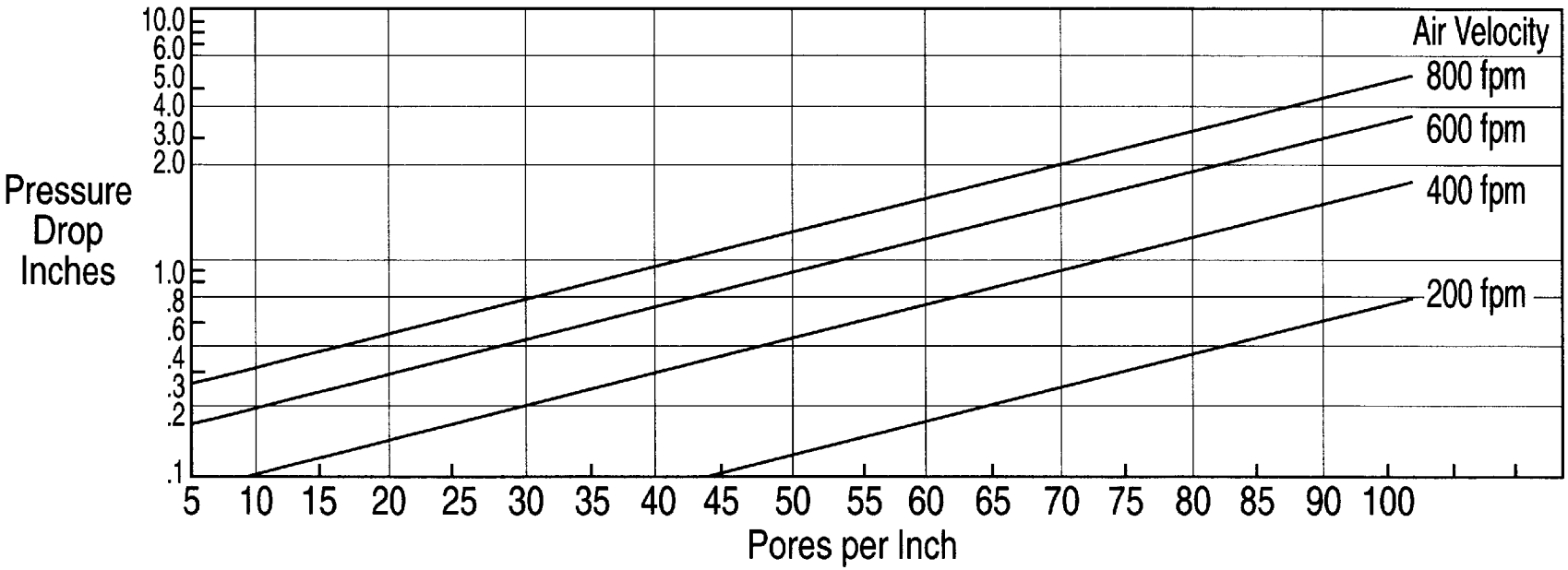
FIG. 8 is a graph showing the pressure drop across a reticulated foam as a function of the number of cells per inch and the velocity of air flowing through the reticulated foam.

A wood burning fireplace is an open device. Consequently, there exists a relatively low differential draft pressure between the front of the fireplace and the flue. Any catalytic cleaner, therefore, for use between the smoke chamber and the flue must not have a back pressure that drops the differential draft pressure below that which directs the smoke to the flue. Though increasing the number of pores per linear inch increases the internal surface area per cubic foot of reticulated foam, the increase also increases the material forming the foam. This material increase, increases the back pressure presented to the smoke, thus lowering the differential pressure. Therefore, the number of pores per linear inch must be chosen to prevent an unacceptable decrease of differential draft pressure. Graphs of pressure drop versus pores per linear inch for various air velocities, for typical reticulated foams, are provide in FIG. 8. With these graphs the pore density may be chosen to fit the fireplace characteristics. For example, a reticulated foam having 10 pores per inch presents a back pressure of 0.1 inches of water to an air flow of 400 feet per minute, 0.18 inches of water to an air flow of 600 feet per minute, and 0.29 inches of water to an air flow of 800 feet per minute. Should the differential pressure between the smoke and the flue be greater than 0.3 inches of water, 10 pores per inch would be an acceptable parameter for the reticulated foam. If the differential pressure is less than 3.0 inches of water, but greater than 2.0 inches of water, 10 pores per inch would only be acceptable for fireplaces in which the air flow is less than 600 feet per minute.

When the reticulated foam is completed, the internal surfaces are coated with a catalyst that converts the pollutants comprising the exhaust of the wood burning process to harmless compounds transition metal catalysts, such as combinations of platinum and palladium and platinum and rhodium, may be employed for the conversion. The method for forming a reticulated foam structure is well known in the art and structures meeting given specifications are commercially available or are readily manufactured. Such material may be obtained, in accordance with given specifications or as catalog items from a number of sources, two of which are ERG Materials and Aerospace Corporation of Oakland, Calif. and Vesuvius McDanel of Beaver Falls, Pa.

Efficiency of conversion of pollutants to harmless compounds by a catalyst is a function of the temperature to which the catalytic material is exposed. Catalysts operate efficiently at the exhaust temperatures normally created by an actively burning fire. Though pollutants exist in a growing or smoldering fire, when a fire grows or smolders the exhaust temperature is below that of an active fire. Exhaust temperatures of a growing or smoldering fire may not be sufficient to achieve the conversion efficiency obtained at the exhaust temperatures of an active fire. Should the temperature range of a catalyst be such as not to achieve the most conversion efficiency, heating elements may be included in a reticulated foam structure to increase the temperature of the catalyst during the growing and smoldering fire periods. These heating elements may be thermostatically controlled to turn the heating element on when the exhaust temperature is below the optimum range and to turn it off when the exhaust temperature is in the optimum range.

Figure 9A:
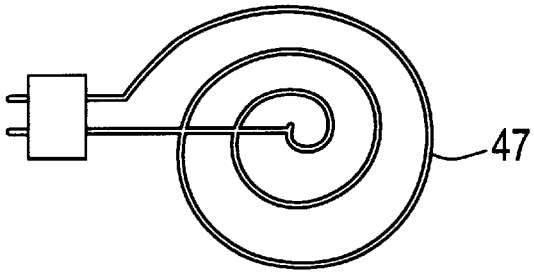
FIG. 9A is a diagram of a spiral electrical heater coil suitable for use as the heater element in FIG. 9.
Figure 9:
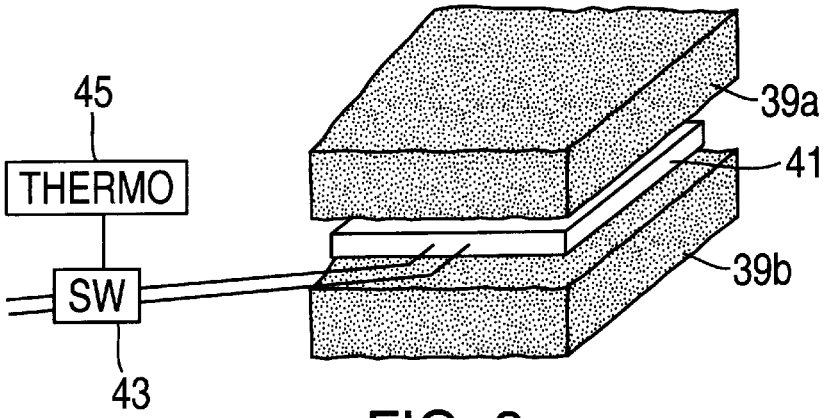
FIG. 9 is diagram of an exhaust catalytic cleaner comprising a heater element sandwiched between two sections of reticulated foam, each coated with catalytic material.

Refer now to FIG. 9, wherein a catalytic cleaner comprising two sections 39*a*, 39*b* of catalytic material coated reticulated foam sandwiching a heater element 41 is shown. The heater element may be coupled to a standard 110 volt AC electrical source via a switch 43, which is operated by a thermostat 45, which may be positioned in the fireplace flue. Switch 43 may be constructed to be normally in the on position. When the thermostat 45 senses an exhaust temperature at or above that required for optimum catalytic conversion efficiency, it causes the switch to turn to the off position, thereby turning the heating element off. The switch remains in the off position until it is thermostatically switched to the on position when the temperature drops below that required for optimum catalytic conversion. A device suitable for use as the heating element 41 may be a spirally shaped electrical conductor 47, shown in FIG. 9A, having sufficient electrical resistance to establish the necessary heat.

Figure 10A:
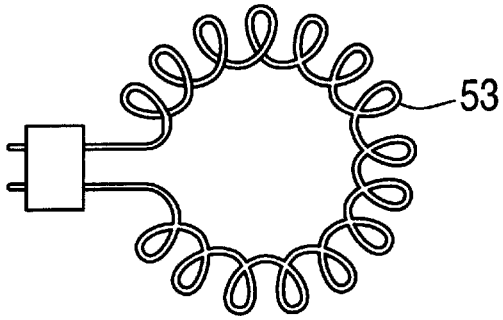
FIG. 10A is a diagram of a circular helical coil which may be employed as the heating element in the exhaust catalytic cleaner diagramed in FIG. 10.
Figure 10:
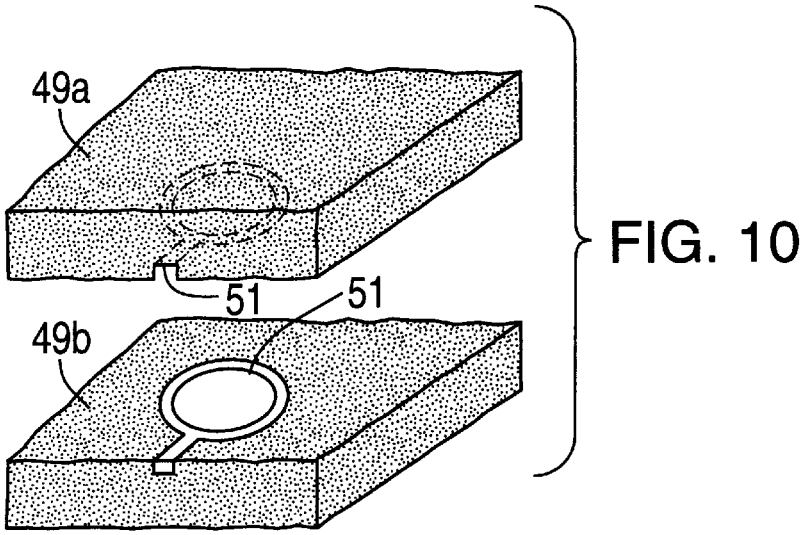
FIG. 10 is a diagram of an exhaust catalytic cleaner comprising two sections of reticulated foam, coated with catalytic material, having provision for inserting a heating element between the two sections.

A heating element may also be provided in a catalyst coated reticulated foam by machining the foam to fit around the heating element. An example of this method for providing a heating element is shown in FIG. 10. Reticulated foam comprising two sections 49*a*, 49*b* is machined to provide a circular region 51 into which a heating element, that may be in the form of a circular helix 53 shown in FIG. 10A, may be imbedded. The circular region 51 may be machined to equal depths in each section, to unequal depths, or in one section only. It should be recognized that shape of the grove and heating element is not critical, any geometrical shape for the grove and heating element may be used. After the heating element is inserted, the reticulated foam and the heating element may be coated with a catalyst and the two sections fit together to form an integrated unit. Alternatively, the foam may be coated with a catalyst prior to the insertion of the heating element and the fitting together of the two sections.

Figure 11:
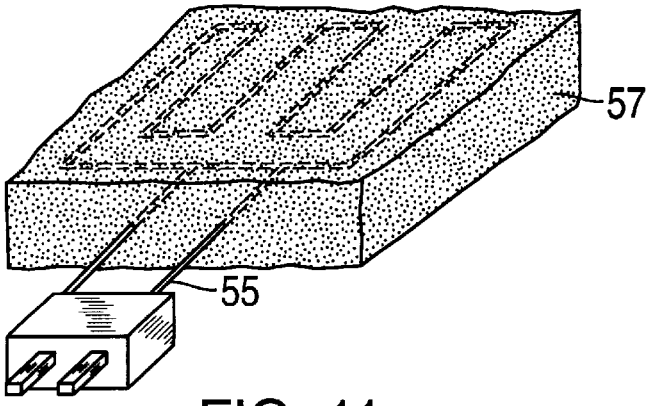
FIG. 11 is a diagram of a high resistance electrical conducting material, constructed in a manner to allow fluid to flow therethrough, coated with a catalyst and embodied in a reticulated foam comprising a ceramic material coated with a catalyst.

Another method of providing a heating element to a catalyst coated reticulated foam is shown in FIG. 11. A high resistance electrical conductor, such as a nicrome wire 55 may be woven through a catalyst coated reticulated foam 57. This has the advantage of utilizing a one piece foam structure. But has the disadvantage of finding a wire path through the foam.

Figure 12:
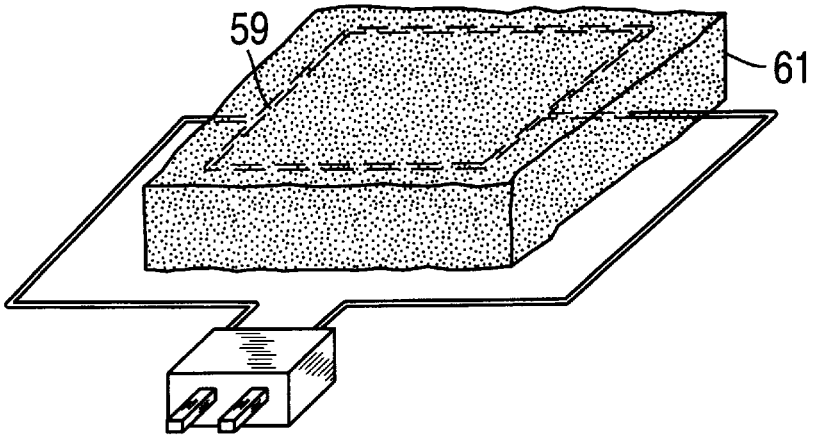
FIG. 12 is a diagram of a block of reticulated foam, coated with catalytic material, through which a heating element is woven.
Figure 13:
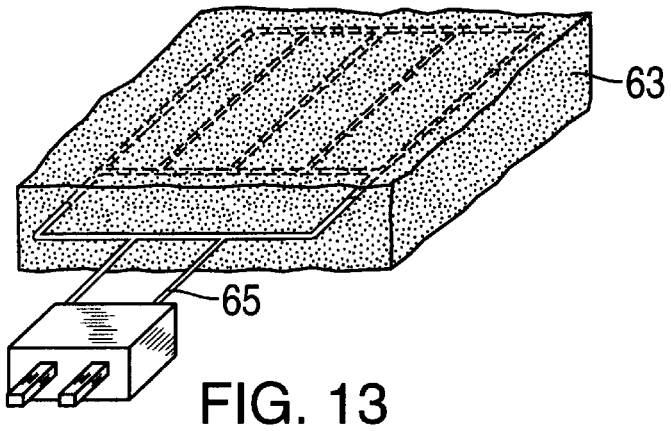
FIG. 13 is a diagram of a reticulated foam coated with a catalytic material through which electrical current may flow for heating the unit.

Fully integrated heater-foam units may be provided as shown in FIGS. 12 and 13. In FIG. 12, the inner portion 59 of a catalyst coated reticulated foam 61 may be constructed of high resistance electrical conducting material. An electrical current applied to the inner section will create the heat required for raising the temperature of the entire foam structure.

A catalytic converter is, in general, a poor conductor of electricity, having a high resistance to electrical current. Consequently, current flowing through the catalyst causes it to heat, increasing the temperature of the catalyst, thereby establishing the catalyst as its own heater. FIG. 13 shows a catalyst coated reticulated foam structure 63 with low electrical resistance wiring 65 coupled to the catalyst for applying a source of electrical current.

While the invention has been described in its preferred embodiments, it is to understood that the words that have been used are words of description rather than limitation and that changes may be made within the purview of the appended claims without departing from the true scope and spirit of the invention in its broader aspects.

We claim:

1. A catalytic cleaner for reducing pollutants in emissions from wood burning in a fireplace having a smoke chamber and a flue comprising:

a reticulated foam having external porous surfaces and internal pores interconnected by ligaments, said pores and ligaments in total, providing a low density structure with a high internal void volume and a high internal surface area, thereby, when positioned in a flow path of said emissions, producing a back pressure that is less than differential pressure between said flue and said smoke chamber; and a catalyst coating on said internal surface area which converts pollutants flowing through said pores to harmless compounds, thereby creating a catalyst coated reticulated foam.

2. A catalytic cleaner in accordance with claim 1 wherein said reticulated foam is constructed of a ceramic material and said catalyst comprises a transition metal.

3. A catalytic cleaner in accordance with claim 2 wherein said transition metal is a combination of platinum and palladium.

4. A catalytic cleaner in accordance with claim 2 wherein said transition metal is a combination of platinum and rhodium.

5. A catalytic cleaner in accordance with claim 2 wherein said transition metal is platinum.

6. A catalytic cleaner in accordance with claim 1 wherein said reticulated foam is configured for positioning in said flue.

7. A catalytic cleaner in accordance with claim 1 wherein said reticulated foam is configured for positioning between said flue and said smoke chamber.

8. A catalytic cleaner in accordance with claim 1 wherein said catalyst coated reticulated foam is constructed in first and second sections and further includes an electrical heating element between said first and second sections.

9. A catalytic cleaner in accordance with claim 8 further including:

an on-off switch coupled to said heating element; and a thermostat coupled to said on-off switch.

10. A catalytic cleaner in accordance with claim 8 wherein said heating element is a spiraled electrical element.

11. A catalytic cleaner in accordance with claim 1 wherein said catalyst coated reticulated foam is constructed in first and second sections with a geometrically shaped groove of predetermined depth in at least one of said sections and further includes an electrical heating element shaped to fit within said geometrically shaped groove.

12. A catalytic cleaner in accordance with claim 11 further including:

an on-off switch coupled to said electrical heating element; and a thermostat coupled to said on-off switch.

13. A catalytic cleaner in accordance with claim 11 wherein said geometrically shaped groove is circular and said electrical heating element is constructed to form a circular helix.

14. A catalytic cleaner in accordance with claim 1 wherein said catalytic coated reticulated foam includes an inner region comprising an electrical heating element coated with ceramic and catalytic material.

15. A catalytic cleaner in accordance with claim 16 further comprising:

an on-off switch coupled to said heating element; and a thermostat coupled to said on-off switch.

16. A catalytic cleaner in accordance with claim 1 wherein an electrical heating element is woven through said catalytic coated reticulated foam.

17. A catalytic cleaner in accordance with claim 16 further comprising:

an on-off switch coupled to said heating element; and a thermostat coupled to said on-off switch.

18. A catalytic cleaner in accordance with claim 1 wherein said catalyst coating is coupled to an electrical plug for coupling to a source of electrical current.

19. A method for converting pollutants in exhausts from wood burning in a fireplace to harmless compounds, the fireplace having a smoke chamber coupled to a flue, comprising the steps of:

providing a reticulated foam having external porous surfaces and internal pores interconnected by ligaments, said pores and ligaments in total, providing a low density structure with a high internal void volume and a high internal surface area thereby, when positioned in a flow path of said emissions, producing a back pressure that is less than differential pressure between said flue and said smoke chamber;

coating said internal surface area with a catalyst which converts pollutants flowing through said pores to harmless compounds, thereby providing a coated reticulated foam; and positioning said coated reticulated foam in fluid flow path of said exhaust.

20. A method for converting pollutants in exhausts from wood burning in a fireplace to harmless compounds in accordance with claim 19 wherein said providing step includes the steps of:

determining exhaust fluid flow velocity from said smoke chamber to said flue;

utilizing said exhaust fluid flow velocity to select pore density in said reticulated foam in pores per linear unit.

21. A method for converting pollutants in exhausts from wood burning in a fireplace to harmless compounds in accordance with claim 19 wherein said positioning step positions said coated reticulated foam in said flue at its base.

22. A method for converting pollutants in exhausts from wood burning in a fireplace to harmless compounds in accordance with claim 19 wherein said positioning step positions said coated reticulated foam between said smoke chamber and said flue.

23. A method for converting pollutants in exhausts from wood burning in a fireplace to harmless compounds in accordance with claim 19 wherein said reticulated foam provided in said providing step is constructed of a ceramic material.

24. A method for converting pollutants in exhausts from wood burning in a fireplace to harmless compounds in accordance with claim 19 wherein said coating step coats said internal surfaces with a transition metal catalyst.

25. A method for converting pollutants in exhausts from wood burning in a fireplace to harmless compounds in accordance with claim 24 wherein said transition metal is a combination of platinum and palladium.

26. A method for converting pollutants in exhausts from wood burning in a fireplace to harmless compounds in accordance with claim 24 wherein said transition metal is a combination of platinum and rhodium.

27. A method for converting pollutants in exhausts from wood burning in a fireplace to harmless compounds in accordance with claim 24 wherein said transition metal is platinum.

28. A method for converting pollutants in exhausts from wood burning in a fireplace to harmless compounds in accordance with claim 19 further including the steps of:

constructing said catalyst coated reticulated foam in first and second sections; and locating an electrical heating element between said first and second sections.

29. A method for converting pollutants in exhausts from wood burning in a fireplace to harmless compounds in accordance with claim 28 further including the steps of:

coupling an on-off switch to said electrical heating element; and coupling a thermostat to said on-off switch.

30. A method for converting pollutants in exhausts from wood burning in a fireplace to harmless compounds in accordance with claim 19 further including the steps of:

constructing said catalyst coated reticulated foam in first and second sections;

establishing a geometrically shaped groove in at least one of said first and second sections; and locating an electrical heating element in said groove.

31. A method for converting pollutants in exhausts from wood burning in a fireplace to harmless compounds in accordance with claim 30 further including the steps of:

coupling an on-off switch to said electrical heating element; and coupling a thermostat to said on-off switch.

32. A method for converting pollutants in exhausts from wood burning in a fireplace to harmless compounds in accordance with claim 19 wherein said providing step includes the step of forming an inner region having an electrical heating element coated with ceramic and catalytic material.

33. A method for converting pollutants in exhausts from wood burning in a fireplace to harmless compounds in accordance with claim 32 further including the steps of:

coupling an on-off switch to said electrical heating element; and coupling a thermostat to said on-off switch.

34. A method for converting pollutants in exhausts from wood burning in a fireplace to harmless compounds in accordance with claim 19 further including the step of weaving an electrical heating element through said reticulated foam.

35. A method for converting pollutants in exhausts from wood burning in a fireplace to harmless compounds in accordance with claim 34 further including the steps of:

coupling an on-off switch to said electrical heating element; and coupling a thermostat to said on-off switch.

36. A method for converting pollutants in exhausts from wood burning in a fireplace to harmless compounds in accordance with claim 19 further including the step of coupling said catalyst coating to an electrical plug for coupling to a source of electrical current.

* * * * *

UNITED STATES PATENT AND TRADEMARK OFFICE

CERTIFICATE OF CORRECTION

PATENT NO. : 6,237,587 B1
DATED : May 29, 2001
INVENTOR(S) : Ralph C. Sparling, Lance C. Grace and Lincoln D. Busselle It is certified that error appears in the above-identified patent and that said Letters Patent is hereby corrected as shown below:

Title page,
Inventors, at the end of the list, delete "MN" (the abbreviation for Minnesota) and insert therefore NM (the abbreviation for New Mexico)

Signed and Sealed this

Sixteenth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,237,587 B1
DATED : May 29, 2001
INVENTOR(S) : Ralph C. Sparling, Lance C. Grace, and Linclon D. Busselle It is certified that error appears in the above-identified patent and that said Letters Patent is hereby corrected as shown below:

Title page,
At the end of the list of inventors delete MN (the abbreviation for Minnesota) and insert therefore NM (the abbreviation for New Mexico)

Signed and Sealed this

Twenty-third Day of April, 2002

*Attest:*

*Attesting Officer*

JAMES E. ROGAN
*Director of the United States Patent and Trademark Office*